US010218089B2

(12) United States Patent
Eck et al.

(10) Patent No.: US 10,218,089 B2
(45) Date of Patent: Feb. 26, 2019

(54) CONTACTING DEVICE FOR CONTACTING AN ELECTRICAL CONDUCTOR TO AN ELECTRICAL CONDUCTOR PATH

(71) Applicant: EATON ELECTRICAL IP GMBH & CO. KG, Schoenefeld (DE)

(72) Inventors: Sergei Eck, Dierdorf (DE); Julia Otte, Cologne (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/560,488

(22) PCT Filed: Mar. 18, 2016

(86) PCT No.: PCT/EP2016/056000

§ 371 (c)(1),
(2) Date: Jan. 10, 2018

(87) PCT Pub. No.: WO2016/150863

PCT Pub. Date: Sep. 29, 2016

(65) Prior Publication Data

US 2018/0145429 A1 May 24, 2018

(30) Foreign Application Priority Data

Mar. 23, 2015 (DE) ..... 10 2015 104 270

(51) Int. Cl.
*H01R 4/48* (2006.01)
*H01H 71/08* (2006.01)

(52) U.S. Cl.
CPC ..... *H01R 4/4818* (2013.01); *H01R 4/4836* (2013.01); *H01H 71/08* (2013.01)

(58) Field of Classification Search
CPC ..... H01R 4/4818; H01R 4/4836; H01H 71/08
(Continued)

(56) References Cited

U.S. PATENT DOCUMENTS 4,566,749 A * 1/1986 Johnston ..... H01R 24/62 439/425
6,341,989 B1 * 1/2002 Jaag ..... H01R 4/4827 439/725

(Continued)

FOREIGN PATENT DOCUMENTS

CN 101174523 A 5/2008
DE 2225591 A 12/1973

(Continued)

*Primary Examiner* — Alexander Gilman
(74) *Attorney, Agent, or Firm* — Leydig, Voit & Mayer, Ltd

(57) ABSTRACT

A contacting device for bringing an electrical conductor into contact with an electrical conductor path includes a housing having a first opening for inserting the electrical conductor into a cavity in the housing and a second opening for inserting the electrical conductor path into the cavity in the housing, and a bow collector including a first portion, which is arranged in the cavity in the housing, and a second portion. The bow collector is designed such that the electrical conductor can be pressed against the electrical conductor path by the first portion of the bow collector after the electrical conductor and electrical conductor path have been inserted into the cavity in the housing, as a result of which the electrical conductor is retained on the electrical conductor path in a clamping position so as to be in contact with the electrical conductor path.

13 Claims, 5 Drawing Sheets

(58) Field of Classification Search
USPC ..... 439/709
See application file for complete search history.

(56) References Cited

U.S. PATENT DOCUMENTS 6,689,955 B2 * 2/2004 Doutaz ..... H01R 4/4836 174/135
7,438,587 B2 * 10/2008 Germani ..... H01R 4/4836 439/441
8,062,077 B2 * 11/2011 Hayashi ..... H01R 9/2408 439/725
8,444,443 B2 * 5/2013 Schafmeister ..... H01R 4/4836 439/441
9,337,556 B2 * 5/2016 Rask ..... F04D 13/0686
9,413,085 B2 * 8/2016 Hoppmann ..... H01R 4/4854
9,543,700 B2 * 1/2017 Kollmann ..... H01R 4/4836
9,859,649 B2 * 1/2018 Konietzko ..... H01R 9/24
2004/0217831 A1 * 11/2004 Bauer ..... H01H 11/0031 335/202
2007/0082551 A1 * 4/2007 Oesterhaus ..... H01R 4/4827 439/607.01
2009/0253306 A1 * 10/2009 Knoerrchen ..... H01R 4/4836 439/651
2011/0209972 A1 * 9/2011 Eppe ..... H01H 71/08 200/293

FOREIGN PATENT DOCUMENTS

DE 20307509 U1 7/2003
DE 60000963 T2 9/2003
DE 102008017245 A1 10/2009
DE 102012000180 A1 7/2013
JP 10177870 A 6/1998
WO WO 2005122335 A1 12/2005
WO WO 2010034430 A1 4/2010

* cited by examiner

CONTACTING DEVICE FOR CONTACTING AN ELECTRICAL CONDUCTOR TO AN ELECTRICAL CONDUCTOR PATH

CROSS-REFERENCE TO PRIOR APPLICATIONS

This application is a U.S. National Phase application under 35 U.S.C. § 371 of International Application No. PCT/EP2016/056000, filed on Mar. 18, 2016, and claims benefit to German Patent Application No. DE 10 2015 104 270.3, filed on Mar. 23, 2015. The International Application was published in German on Sep. 29, 2016 as WO 2016/150863 under PCT Article 21(2).

FIELD

The invention relates to a contacting device for bringing an electrical conductor into contact with an electrical conductor path, it being possible to fasten the contacting device to a body of an electrical component that contains the electrical conductor path.

BACKGROUND

In order to fasten an electrical conductor to an electrical conductor path that is arranged in a body of an electrical component, for example a protective motor switch, a protective power switch, a motor contactor, a power contactor or a thermal relay, a contacting device is required.

SUMMARY

In an embodiment, the present invention provides a contacting device for bringing an electrical conductor into contact with an electrical conductor path, comprising: a housing comprising a first opening for inserting the electrical conductor into a cavity in the housing and a second opening for inserting the electrical conductor path into the cavity in the housing; and a bow collector comprising a first portion, which is arranged in the cavity in the housing, and a second portion, wherein the bow collector is configured such that the electrical conductor is configured to be pressed against the electrical conductor path by the first portion of the bow collector after the electrical conductor and electrical conductor path have been inserted into the cavity in the housing, as a result of which the electrical conductor is retained on the electrical conductor path in a clamping position so as to be in contact with the electrical conductor path, and wherein the bow collector is configured such that, using the second portion of the bow collector, the contacting device is configured to be fastened to a structure of a body of an electrical component, which structure is different from the electrical conductor path, in order to provide the electrical conductor path.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

In an embodiment, the present invention provides a contacting device for bringing an electrical conductor into contact with an electrical conductor path comprises a housing comprising a first opening for inserting the electrical conductor path into a cavity in the housing and a second opening for inserting the electrical conductor path into the cavity in the housing. The contacting device further comprises a bow collector comprising a first portion, which is arranged in the cavity in the housing, and a second portion. The bow collector is designed such that the electrical conductor is pressed against the electrical conductor path by means of the first portion of the bow collector after said electrical conductor and electrical conductor path have been inserted into the cavity in the housing, as a result of which the electrical conductor is held on the electrical conductor path in a clamping position so as to be in contact with the electrical conductor path. The bow collector is designed such that the contacting device can be fastened to a body of an electrical component by means of the second portion of the bow collector in order to provide the electrical conductor path.

The contacting device is designed as a modular terminal in which the bow collector, which is responsible for bringing the electrical conductor into contact with the electrical conductor path or current path, is also simultaneously the element providing the connection between the body of the electrical component and the modular terminal block. The bow collector is a spring element. One leg of the bow collector clamps the electrical conductor to be connected to the conductor path or current path. The other leg of the bow collector connects the contacting device to the body of the electrical component.

The electrical conductor path, which is arranged on the body of the electrical component, is used in the contacting device directly as a contacting surface for the electrical conductor(s) to be connected. This means that a steel frame or steel cage, which usually retains the position and function of the bow collector, can be omitted. An additional transition resistor, which is otherwise provided between the electrical conductor, the steel frame and the electrical conductor path of the body of the electrical component, is therefore not required.

In the contacting device described, the bow collector is integrated in an inner housing body, which may be designed as a plastics frame, and the position and function thereof is retained therein. The inner housing body having the bow collector arranged therein may be inserted into modular components or into an outer housing body. The shape of the outer housing body may be adapted to the shape of the body of the electrical component such that the housing of the contacting device can be fastened to the body of the electrical component. The outer housing body and the body of the electrical component may therefore be interlocked, for example.

Figure 1:
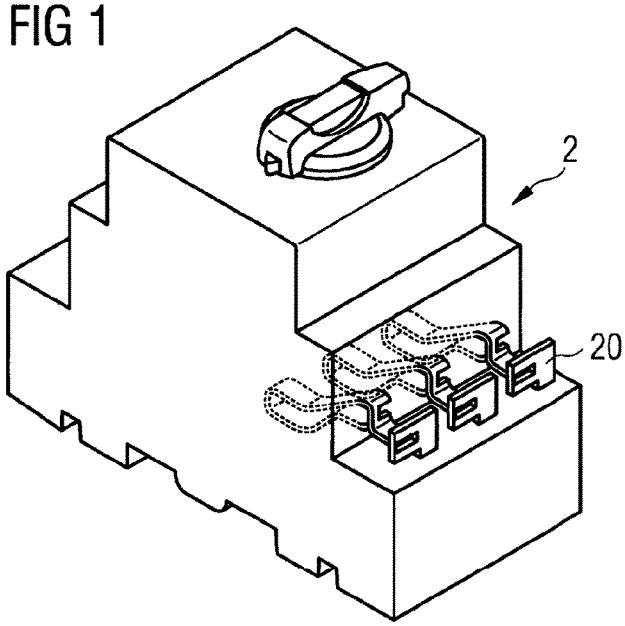
FIG. 1 shows a body of an electrical component comprising an electrical conductor path for contacting an electrical conductor.

FIG. 1 shows an outer body of an electrical component 2 in which an electrical conductor path 20 is arranged. Part of the electrical conductor path 20 projects out of the body of the electrical component 2 in order to contact an electrical conductor. The electrical component may for example be a protective motor switch, a protective power switch, a motor contactor, a power contactor or a thermal relay, to give just some examples.

Figure 2:
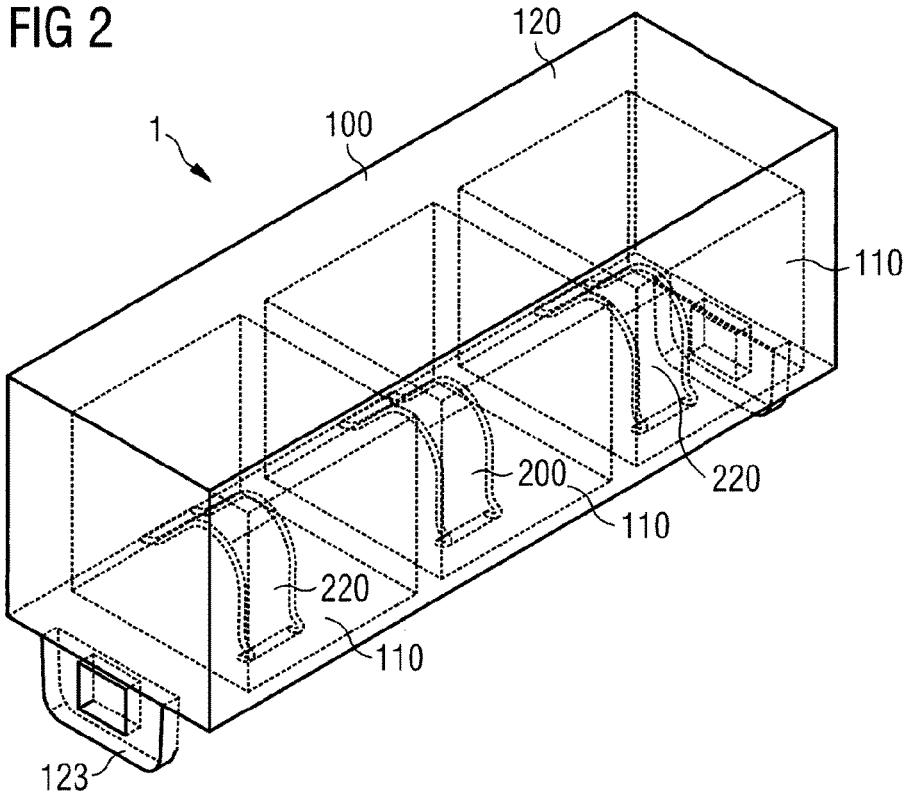
FIG. 2 shows a contacting device for bringing an electrical conductor into contact with an electrical conductor path.

FIG. 2 shows an embodiment of a contacting device 1 comprising a housing 100. The housing 100 comprises at least one inner housing body 110, which is surrounded by an outer housing body 120. The at least one inner housing body comprises a cavity in which a bow collector 200 is arranged. In the exemplary embodiment of the contacting device shown in FIG. 2, three inner housing bodies 110 are surrounded by an outer housing body 120, for example. The contacting device 1 may be attached to the body of the electrical component 2 such that the electrical conductor paths 20 project into each of the cavities in the inner housing body 110. The inner housing bodies may comprise respective openings on the base surfaces thereof for this purpose. By means of the relevant bow collector 200, an electrical conductor that is inserted into one of the cavities in the inner housing body 110 can be clamped to the electrical conductor path 20 introduced into the cavity.

Figure 3:
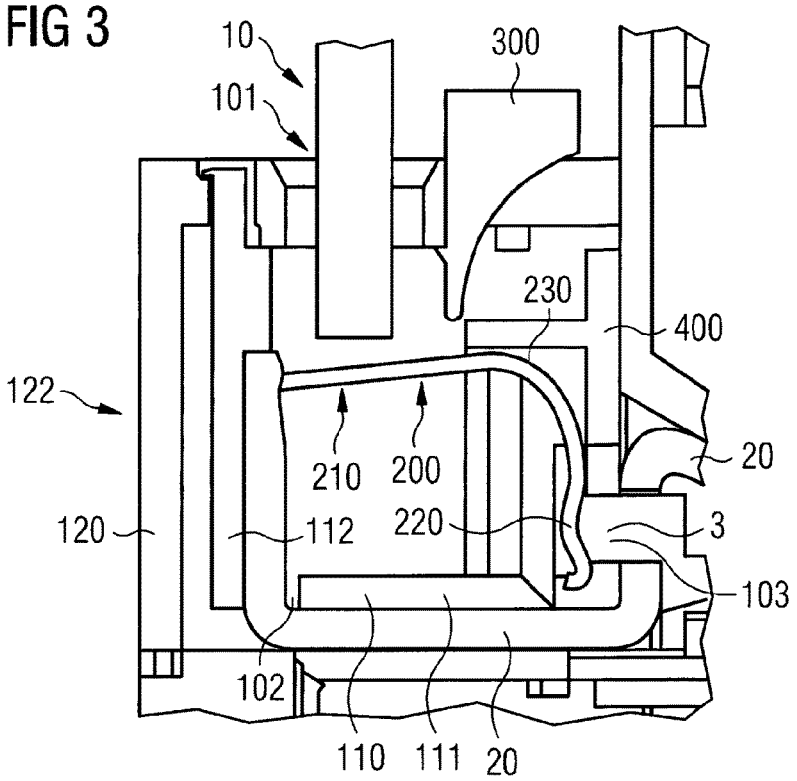
FIG. 3 is a cross section through a contacting device for bringing an electrical conductor into contact with an electrical conductor path.
Figure 4:
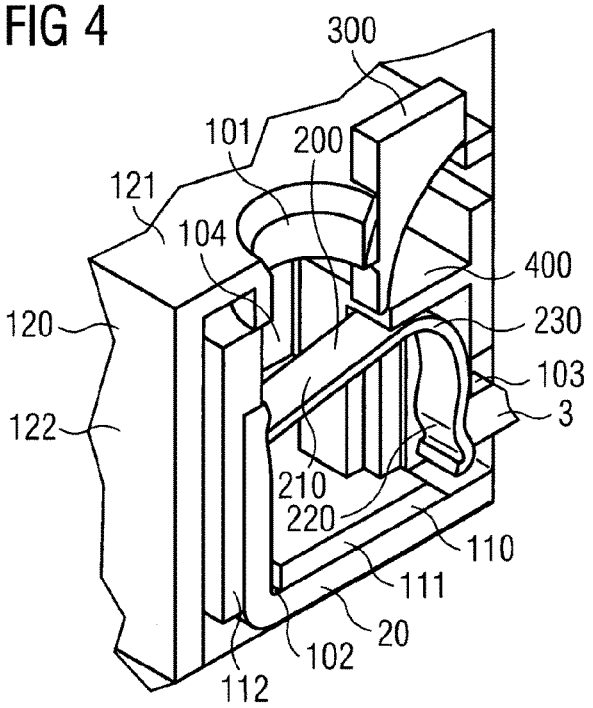
FIG. 4 is a perspective view of a contacting device for bringing an electrical conductor into contact with an electrical conductor path.
Figure 5:
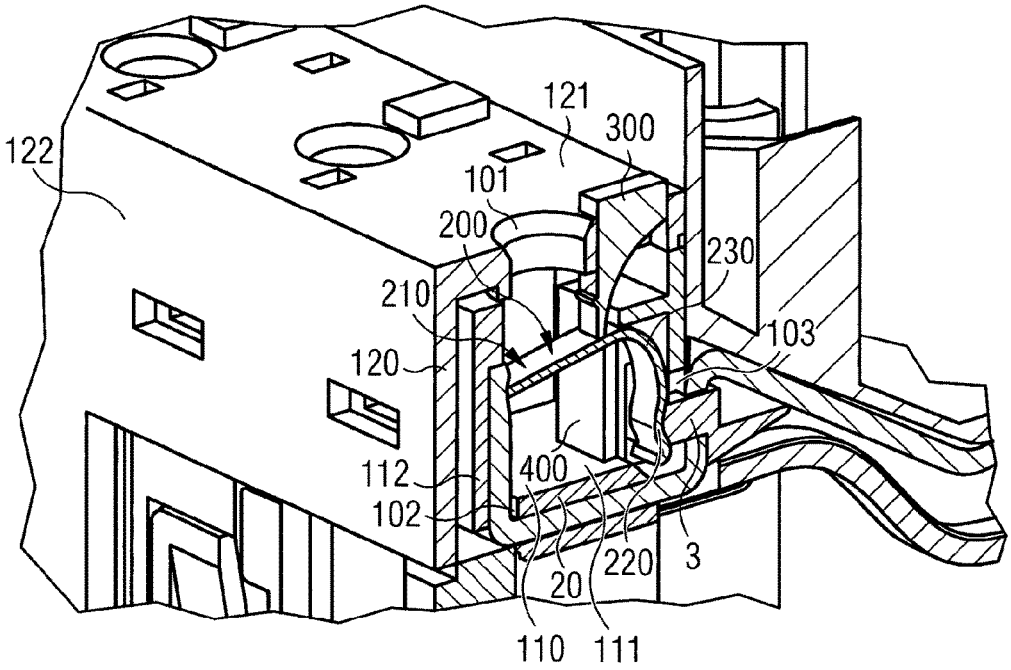
FIG. 5 is a perspective view of a contacting device for bringing an electrical conductor into contact with an electrical conductor path.
Figure 6:
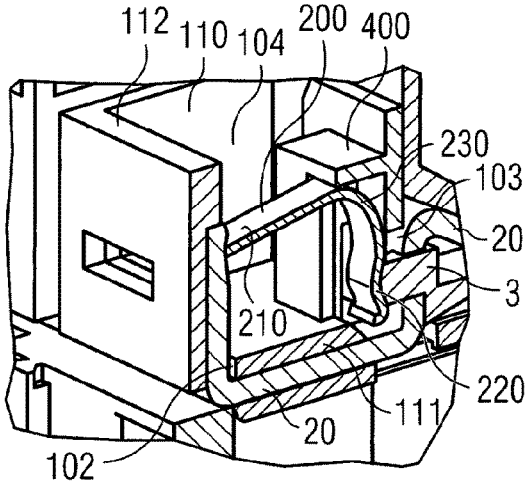
FIG. 6 is a perspective view of an inner housing body of a contacting device for bringing an electrical conductor into contact with an electrical conductor path.

Embodiments of the contacting device 1 are described in detail on the basis of the following figures. FIG. 3 is a section through an embodiment of a contacting device 1 for bringing an electrical conductor 10 into contact with an electrical conductor path 20 arranged in a main body of the electrical component 2. FIGS. 4 and 5 are each perspective views of a section through the contacting device 1. FIG. 6 shows a section through an inner housing body 110 of the housing 100 of the contacting device 1.

The contacting device 1 for bringing the electrical conductor 10 into contact with the electrical conductor path 20 comprises the housing 100 already described above and the bow collector 200. The housing 100 comprises a first opening 101 for inserting the electrical conductor 10 into a cavity 104 in the housing 100. Furthermore, the housing 100 comprises a second opening 102 for inserting the electrical conductor path 20 into the cavity 104 in the housing. The electrical conductor path 20 is arranged on the body of the electrical component 2, a portion of the conductor path 20 projecting out of the body of the electrical component.

The bow collector 200 comprises a first portion 210, which is arranged in the cavity 104 in the housing 100. Furthermore, the bow collector 200 comprises a second portion 220. The second portion 220 is accessible from outside through a third opening 103 in the housing 100. The second portion 220 may be arranged within the housing. According to a possible embodiment, just one region of the second portion 220 of the bow collector may protrude or project out of the third opening 103. The bow collector 200 is designed such that the electrical conductor 10 is pressed against the electrical conductor path 20 by means of the first portion 210 of the bow collector 200 after said electrical conductor 10 and electrical conductor path 20 have been inserted into the cavity 104 in the housing. The bow collector 200 and the electrical conductor path 20 are separate elements that are not connected to one another or are not fastened to one another. Only when an electrical conductor is not inserted into the cavity 104 in the housing can the end of the first portion 210 of the bow collector touch the electrical conductor path 20.

As a result, the electrical conductor 10 is held on the electrical conductor path 20 in the clamping position so as to be in contact with the electrical conductor path 20. The bow collector 200 is furthermore designed such that the contacting device 1 can be fastened to the body of the electrical component 2 by means of the second portion 220 of the bow collector 200. The bow collector 200 is thus used both to directly clamp the electrical conductor 10 to the electrical conductor path or current path 20 and to attach the contacting device 1 to the body of the electrical component 2.

The first portion 210 of the bow collector 200 may be formed as a resilient leg which is initially bent downwards when the electrical conductor 10 is inserted through the opening 101 into the cavity 104 in the housing 100. The bow collector 200 is designed and retained in the housing 100 such that it generates a restoring force owing to this bending, by means of which force said bow collector presses the electrical conductor 10 against the electrical conductor path 20 such that the electrical conductor 10 is clamped onto the conductor path 20.

The second portion 220 of the bow collector 200 is designed as a latch element for latching into a structure 3 of the body of the electrical component 2, in order to fasten the contacting device 1 to the body of the electrical component. The second portion 220 of the bow collector is arranged in the housing 100 such that it is accessible from outside through the opening 103 in the housing. The structure 3 is designed as a structure of the body/housing of the electrical component that is different from the electrical conductor path 20. The structure 3 may for example be a projection or lug on the body of the electrical component 2 which latches into the curved second portion 220 of the bow collector, in order to fasten the contacting device 1 to the body of the electrical component 2. When fastened, the electrical conductor path 20 penetrates into the cavity 104 in the housing through the second opening 102 in the housing.

The bow collector 200 may comprise a third portion 230 between the first and second portion 210, 220, at which third portion the bow collector 200 is fastened to the housing 100. According to a possible embodiment, the contacting device 1 may further comprise a lever 300 for moving the first portion 210 of the bow collector 200 against the restoring force in order to release the electrical conductor 10 from the clamping position by pressing down the first portion 210 of the bow collector.

According to a possible embodiment, a retaining element 400 may be arranged within the cavity 104 in the housing, on which element the bow collector 200 is retained in terms of position and function within the housing. The retaining element 400 is designed such that the bow collector 200 is supported from the sides and from the top.

The housing 100 may comprise an inner housing body 110 and an outer housing body 120. The inner housing body 110 may be arranged in the outer housing body 120 at least in part. The bow collector 200 is arranged in the inner housing body 110.

According to a possible embodiment of the housing 100, the inner housing body 110 is designed as a hollow body having a base surface 111 and side walls 112, which define the cavity 104 in the housing 100 at the sides and from below. The second opening 102 in the housing for inserting the electrical conductor path 20 into the cavity 104 in the housing 100 may be arranged in the base surface 111 of the inner housing body 110. The third opening 103 in the housing 100 may be arranged on one of the side walls 112 of the inner housing body 110. The second portion 220 of the bow collector is arranged in the housing such that it ends above the base surface 111 of the inner housing body 110 and in particular does not project out of the base surface 111.

According to another possible embodiment of the housing, the outer housing body 120 is designed as a hollow body having a cover 121 and side walls 122. The outer housing body 120 is arranged over the inner housing body 110 such that an open side of the inner housing body 110 is covered by the cover surface 121 of the outer housing body 120. The side walls 112 of the inner housing body 110 are surrounded by the side walls 122 of the outer housing body 120. The outer housing body 120 is placed over the inner housing body 110. The first opening 101 in the housing 100 is arranged in the cover part 121 of the outer housing body 120. Likewise, the lever 300 is also arranged in the cover part 121 of the outer housing body 120.

The inner housing body 110 may be designed as a plastics frame, and forms a modular inner housing of the contacting device together with the bow collector. The outer shape of the outer housing body may be adapted to the outer body of the electrical component 2, and forms the modular outer housing of the contacting device. As a result, the contacting device may be attached to the body of the electrical component 2 in an interlocking manner.

Figure 7:
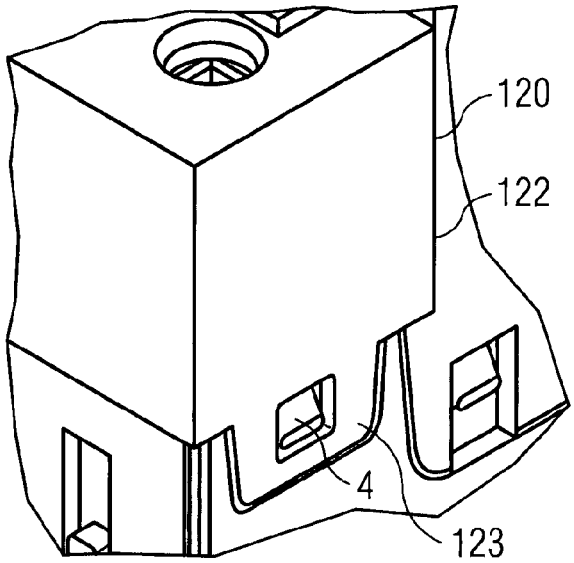
FIG. 7 shows an outer housing body of a contacting device for bringing an electrical conductor into contact with an electrical conductor path.

FIG. 7 shows an embodiment of the outer housing body 120, which is arranged over the inner housing body 110. In order to fasten the contacting device 1 to the body of the electrical component 2, a latch element 123 for latching into an appropriately shaped structural element 4 of the body of the electrical component 2 is arranged on at least one of the outer side walls 122 of the outer housing body 120. In the embodiment shown in FIG. 7, the latch element 123 is designed as a flexible tab or as a snap-in hook. The structural element 4 may be provided in the form of a projection on the body of the electrical component 2, into which the snap-in hook 123 latches. As a result, in addition to the connection between the structure 3 of the body of the electrical component and the portion 220 of the bow collector, an additional fastening option is provided which means that the contacting device 1 is safely retained on the main device 2.

Figure 8:
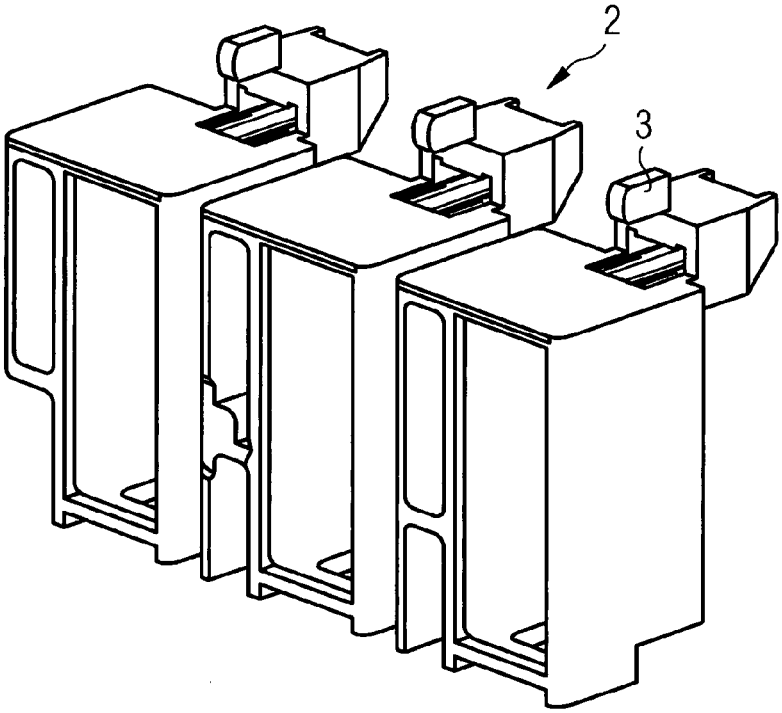
FIG. 8 shows a body of an electrical component for providing an electrical conductor path.

FIG. 8 shows an embodiment of the body of the electrical component 2, comprising the structure 3 for latching the second portion 220 of the bow collector 200. Below the structure 3, the body of the electrical component comprises an opening through which the electrical conductor path 20 projects out of the body.

Figure 9:
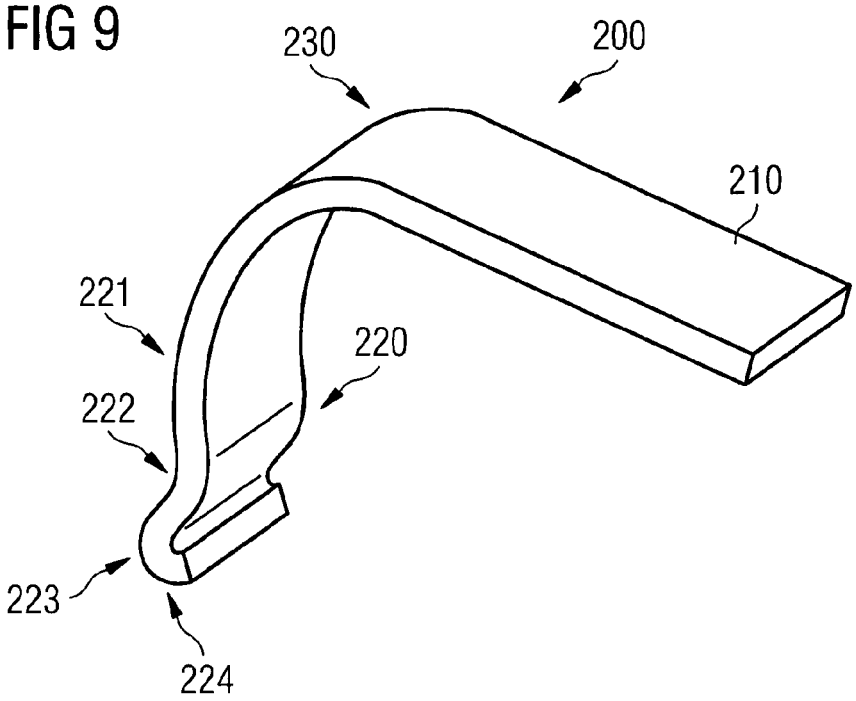
FIG. 9 shows an embodiment of a bow collector of a contacting device for bringing an electrical conductor into contact with an electrical conductor path.

FIG. 9 shows an embodiment of the bow collector 2 comprising the first portion 210 for pressing the electrical conductor 10 against the electrical conductor path 20 and the second portion 220 for fastening the contacting device 1 to the body of the electrical component 2. The bow collector is curved such that the first portion 210 can be arranged in the cavity 104 in the housing in the form of a resilient, free leg. The second portion 220 of the bow collector is designed as a leg that acts as a "catch", into which the structural element 3 can latch so that the bow collector can be clamped against the body of the electrical component. The second portion 220 of the bow collector 200 is formed such that the contacting device 1 is retained on the body of the electrical component 2 in the clamped position.

The second portion 220 of the bow collector comprises a first region 221 that is adjacent to the third portion 230, a second region 222 that is adjacent to the first region 221 and a third region 223 that is adjacent to the second region, which third region constitutes the end of the bow collector arranged above the base surface 111 of the inner housing body. The first and third regions 221 and 223 of the bow collector are curved outwards towards the side wall 112 of the inner housing body, while the second region 222 of the bow collector arranged between the first and third regions 221, 223 is curved inwards towards the cavity 104 in the housing.

The second portion 220 of the bow collector may comprise a fourth region 224 that is adjacent to the third region 223 and is curved towards the cavity 104 in the housing. The fourth portion ends above the base surface 111 of the inner housing body 110.

The first, second and third regions 221, 222 and 223 of the second portion 220 of the bow collector may be arranged within the housing 100. According to a possible embodiment, the second region 222 of the second portion 220 of the bow collector may project out of the opening 103 in the side wall 112 of the inner housing body.

Figure 10:
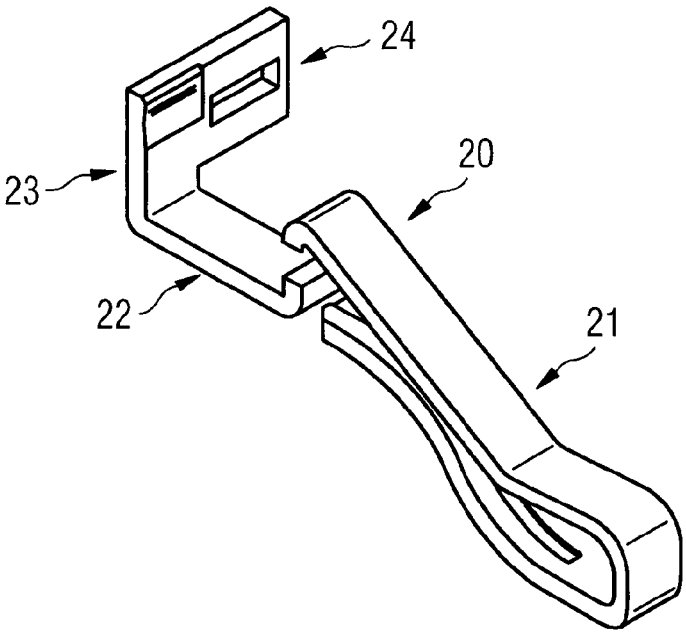
FIG. 10 shows an embodiment of an electrical conductor path of an electrical component.

FIG. 10 shows an embodiment of the electrical conductor path 20, which is attached to the body of the electrical component 2. The electrical conductor path may be designed as a flat conductor comprising a portion 21 that is cast in the body of the electrical component. One portion 22 of the conductor path 20 is arranged below the base surface 111 of the inner housing body 110. Other portions 23 and 24 of the electrical conductor path 20 project through the second opening 102 into the interior of the housing 100 when the contacting device 1 is attached to the body of the electrical component. The side wall 112 comprises a small projection, on which the portion 23 of the conductor path is supported. The portion 23 comprises a specially formed surface in order to retain the electrical conductor 10 in the clamped position by means of the bow collector 200. For this purpose, the upper part of the portion 23 of the electrical conductor path is shaped as a lug projecting into the cavity 104 in the housing 100. The portion 24 of the electrical conductor path 20 is designed as an opening in order to connect a longitudinal connector to the main device by means of a spring element. For this purpose, an opening is also provided in the side walls 112 and 122 of the inner and outer housing body.

By means of the contacting device 1, an additional connecting element is not required when connecting the contacting device to the body of the electrical component, since the contacting device can be attached to the body of the electrical component 2 by the portion 220 of the bow collector 200. Since the bow collector also directly clamps the electrical conductor 10 to be connected to the electrical conductor path 20 by means of the resilient leg 210, an additional transition resistor is not required between the electrical conductor 10 and the electrical conductor path 20. By comparison with a cage construction in conventional push-in technology, the contacting device 1 only requires a small amount of installation space and can be constructed cost-effectively. The contacting device can thus provide a contacting option for bringing an electrical conductor into contact with an electrical conductor path or current path of an electrical component, which option does not have a negative impact on cost, quality or installation space.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 contacting device
2 electrical component
3 structural element
4 structural element
10 electrical conductor
20 electrical conductor path
21 portion
22 portion
23 portion
24 portion
100 housing
101 first opening
102 second opening
103 third opening
104 cavity
110 inner housing body
111 base surface
112 side wall
120 outer housing body
121 cover
122 side wall
123 latch element
200 bow collector
210 first portion
220 second portion
221 first region
222 second region
223 third region
224 fourth region
230 third portion
300 lever
400 retaining element

The invention claimed is:

1. A contacting device for bringing an electrical conductor into contact with an electrical conductor path, comprising:

a housing comprising a first opening for inserting the electrical conductor into a cavity in the housing and a second opening for inserting the electrical conductor path into the cavity in the housing; and a bow collector comprising a first portion, which is arranged in the cavity in the housing, and a second portion, wherein bow collector is configured such that the first portion of the bow collector presses the electrical conductor against the electrical conductor path after the electrical conductor and electrical conductor path have been inserted into the cavity in the housing, so as to retain the electrical conductor on the electrical conductor path in a clamping position so as to be in contact with the electrical conductor path, and wherein the bow collector is configured such that the second portion of the bow collector fastens the contacting device to a structure of a body of an electrical component, which structure is different from the electrical conductor path, in order to provide the electrical conductor path.

2. The contacting device according to claim 1, wherein the first portion of the bow collector comprises a resilient leg which is configured to be bent when the electrical conductor is inserted into the cavity in the housing and, owing to the bending, is configured to generate a restoring force such that the resilient leg presses the electrical conductor against the electrical conductor path.

3. The contacting device according to claim 1, wherein the second portion of the bow collector comprises a latch element configured to latch into a structural element of the body of the electrical component, to fasten the contacting device to the body of the electrical component.

4. The contacting device according to claim 1, wherein the bow collector comprises a third portion between the first and second portion, at which third portion the bow collector is fastened to the housing.

5. The contacting device according to claim 1, wherein the housing comprises a third opening, through which the second portions of the bow collector is accessible from outside.

6. The contacting device according to claim 1, further comprising a lever configured to move the first portion of the bow collector against the restoring force so as to release the electrical conductor from the clamping position.

7. The contacting device according to claim 1, wherein the housing further comprises an inner housing body and an outer housing body and the inner housing body is arranged in the outer housing body at least in part, and wherein the bow collector is arranged in the inner housing body.

8. The contacting device according to claim 7, wherein the inner housing body comprises a hollow body having a base surface and side walls, which define the cavity in the housing, wherein the second opening in the housing for inserting the electrical conductor path into the cavity in the housing is arranged in the base surface of the inner housing body, and wherein the third opening in the housing is arranged on one of the side wails of the inner housing body.

9. The contacting device according to claim 7,

Wherein the outer housing body comprises a hollow body having a cover and side walls, wherein the outer housing body is arranged over the inner housing body such that an open side of the inner housing body is covered by the cover of the outer housing body and the side walls of the inner housing body are surrounded by the side walls of the outer housing body, and wherein the first opening in the housing is arranged in the cover of the outer housing body.

10. The contacting device according to claim 9, wherein a latch element configured to latch into the body of the electrical component is arranged on at least one of the outer side walls of the outer housing body, in order to fasten the outer housing body to the body of the electrical component.

11. A contacting device for bringing electrical conductor into contact with an electrical conductor path, comprising:

a housing comprising a first opening for inserting the electrical conductor into a cavity in the housing and a second opening for inserting the electrical conductor path into the cavity in the housing; and a bow collector comprising a first portion, which is arranged in the cavity in the housing, and a second portion, wherein the how collector is configured such that the electrical conductor is configured to be pressed against the electrical conductor path by the first portion of the bow collector after the electrical conductor and electrical conductor path have been inserted into the cavity in the housing, as a result of which the electrical conductor is retained on the electrical conductor path in a clamping position so as to be in contact with the electrical conductor path, wherein the bow collector is configured such that, using the second portion of the bow collector, the contacting device is configured to be fastened to a structure of a body of an electrical component, which structure is different from the electrical conductor path, in order to provide the electrical conductor path, wherein the housing further comprises an inner housing body and an outer housing body and the inner housing body is arranged in the outer housing body at least in part, wherein the bow collector is arranged in the inner housing body, Wherein the inner housing body comprises a hollow body having a base surface and side walls, which define the cavity in the housing, wherein the second opening in the housing for inserting the electrical conductor path into the cavity in the housing is arranged in the base surface of the inner housing body, and wherein the third opening in the housing is arranged on one of the side walls of the inner housing body.

12. A contacting device for bringing an electrical conductor into contact with an electrical conductor path, comprising:

a housing comprising a first opening for inserting the electrical conductor into a cavity in the housing and a second opening for inserting the electrical conductor path into a cavity in the housing; and a bow collector comprising first portion, which is arranged in the cavity in the housing, and a second portion, wherein the bow collector is configured such that the electrical conductor is configured to be pressed against the electrical conductor path by the first portion of the bow collector after the electrical conductor and electrical conductor path have been inserted into the cavity in the housing, as a result of which the electrical conductor is retained on the electrical conductor path in a clamping position so as to be contact with the electrical conductor path, wherein the bow collector is configured such that, using the second portion of the bow collector, the contacting device is configured to be fastened to a structure of a body of an electrical component, which structure is different from the electrical conductor path, in order to provide the electrical conductor path, wherein the housing further comprises an inner housing body and an outer housing body and the inner housing body is arranged in the outer housing body at least in part, wherein the bow collector is arranged in the inner housing body, wherein the outer housing body comprises a hollow body having a cover and side walls, wherein the outer housing body is arranged over the inner housing body such that an open side of the inner housing body is covered by the cover of the outer housing body and the side walls of the inner housing body are surrounded by the side wails of the outer housing body, and wherein the first opening in the housing is arranged in the cover of the outer housing body.

13. The contacting device according to claim 12, wherein a latch element configured to latch into the body of the electrical component is arranged on at least one of the outer side walls of the outer housing body, in order to fasten the outer housing body to the body of the electrical component.

* * * * *